US007520342B2

(12) United States Patent
Butler et al.

(10) Patent No.: US 7,520,342 B2
(45) Date of Patent: Apr. 21, 2009

(54) RECOVERY SYSTEM

(75) Inventors: Frank Butler, Lafayette, LA (US); Tim Browning, Metairie, LA (US)

(73) Assignee: M-I L.L.C., Houston, TX (US)

( * ) Notice: Subject to any disclaimer, the term of this patent is extended or adjusted under 35 U.S.C. 154(b) by 5 days.

(21) Appl. No.: 11/535,028

(22) Filed: Sep. 25, 2006

(65) Prior Publication Data

US 2007/0221411 A1 Sep. 27, 2007

Related U.S. Application Data

(63) Continuation-in-part of application No. 11/387,442, filed on Mar. 23, 2006, now Pat. No. 7,438,142.

(51) Int. Cl.
*E21B 21/06* (2006.01)

(52) U.S. Cl. ..... 175/66; 175/206

(58) Field of Classification Search ..... 175/65, 175/66, 72, 206, 207
See application file for complete search history.

(56) References Cited

U.S. PATENT DOCUMENTS

| | | | | |
|---|---|---|---|---|
| 4,192,392 | A | 3/1980 | Messines et al. | |
| 4,482,459 | A * | 11/1984 | Shiver | 210/639 |
| 4,915,850 | A * | 4/1990 | Onnes | 210/771 |
| 6,138,834 | A | 10/2000 | Southall | |
| 6,177,014 | B1 | 1/2001 | Potter et al. | |
| 6,881,349 | B2 * | 4/2005 | Mueller | 210/708 |
| 6,892,887 | B2 | 5/2005 | Rayborn | |
| 6,977,048 | B2 * | 12/2005 | Mueller et al. | 210/708 |
| 7,004,333 | B2 | 2/2006 | Marcotullio et al. | |
| 7,077,219 | B1 * | 7/2006 | Chatterji et al. | 175/66 |
| 2004/0094483 | A1 * | 5/2004 | Mueller | 210/708 |

FOREIGN PATENT DOCUMENTS

| | | |
|---|---|---|
| EP | 1083296 | 3/2001 |
| WO | 8902774 | 4/1989 |

OTHER PUBLICATIONS

United States office Action in Corresponding U.S. Appl. No. 11/387,442 (10 pages).
PCT Written Opinion issued in International Application No. PCT/US2007/064831, dated Oct. 8, 2007, (6 pages).
PCT International Search Report issued in International Application No. PCT/US2007/064831, dated Oct. 8, 2007, (3 pages).

* cited by examiner

*Primary Examiner*—George Suchfield
(74) *Attorney, Agent, or Firm*—Osha • Liang LLP

(57) ABSTRACT

A process for the recovery of drilling fluid additives, including industrial carbon, calcium carbonate, natural and synthetic fibers, and other materials from a mixture. The mixture may include drilling fluids, drilled solids, and drilling fluid additives from a mud system. The process may include: separating at least a portion of the drilled solids from the mixture to form a first effluent and a drilled solids fraction; separating at least a portion of the drilling fluid additives from the first effluent to form a second effluent and a recovered additives fraction; and recycling at least a portion of the recovered additives fraction to the mud system. The drilling fluid additives may have a specific gravity greater than 1.4, and may include particles having an average size greater than 2 microns.

18 Claims, 8 Drawing Sheets

200μm EHT = 15.98kV WD = 13mm
Mag = 34X

100μm EHT = 14.00kV WD = 13mm
Mag = 32X

RECOVERY SYSTEM

CROSS-REFERENCE TO RELATED APPLICATIONS

This application is a Continuation-in-Part of U.S. patent application Ser. No. 11/387,442, filed Mar. 23, 2006.

BACKGROUND OF INVENTION

1. Field of the Invention

The invention relates generally to drilling muds, loss circulation materials, industrial materials, and processes to recover the industrial materials for reuse in drilling mud systems.

2. Background Art

When drilling or completing wells in earth formations, various fluids typically are used in the well for a variety of reasons. Common uses for well fluids include: lubrication and cooling of drill bit cutting surfaces while drilling generally or drilling-in (i.e., drilling in a targeted petroliferous formation), transportation of "cuttings" (pieces of formation dislodged by the cutting action of the teeth on a drill bit) to the surface, controlling formation fluid pressure to prevent blowouts, maintaining well stability, suspending solids in the well, minimizing fluid loss into and stabilizing the formation through which the well is being drilled, fracturing the formation in the vicinity of the well, displacing the fluid within the well with another fluid, cleaning the well, testing the well, transmitting hydraulic horsepower to the drill bit, fluid used for implacing a packer, abandoning the well or preparing the well for abandonment, and otherwise treating the well or the formation.

Drilling fluids or muds typically include a base fluid (water, diesel or mineral oil, or a synthetic compound), weighting agents (most frequently barium sulfate or barite is used), bentonite clay to help remove cuttings from the well and to form a filter cake on the walls of the hole, lignosulfonates and lignites to keep the mud in a fluid state, and various additives that serve specific functions, such as polymers, corrosion inhibitors, emulsifiers, and lubricants.

During drilling, the mud is injected through the center of the drill string to the bit and exits in the annulus between the drill string and the wellbore, fulfilling, in this manner, the cooling and lubrication of the bit, casing of the well, and transporting the drill cuttings to the surface. At the surface, the mud can be separated from the drill cuttings for reuse, and the drill cuttings can be disposed of in an environmentally accepted manner.

Recycling drilled solids into the wellbore is undesirable, as this can result in smaller sizes of drilled solids which can accumulate in the drilling fluid. If the solids content increases, additional drilling fluid (water, oil, etc.) must be added to maintain the mud at its desired weight. The drilling mud and drill cuttings returned to the surface are often separated to maintain drilling mud weight, thus avoiding costly dilution. The separated solids are then discarded or disposed of in an environmentally accepted manner.

Drill cuttings can originate from different geological strata, including clay, rock, limestone, sand, shale, underground salt mines, brine, water tables, and other formations encountered while drilling oil and gas wells. Cuttings originating from these varied formations can range in size from less than two microns to several hundred microns. Drill cuttings are commonly classified according to size: smaller than 2 microns are classified as clay; from 2 to 74 microns, silt; 74 to 500 microns, sand; and larger than 500 microns, cuttings. Several types of separation equipment have been developed to efficiently separate the varied sizes of the weighting materials and drill cuttings from the drilling fluid, including shakers (shale, rig, screen), screen separators, centrifuges, hydrocyclones, desilters, desanders, mud cleaners, mud conditioners, dryers, filtration units, settling beds, sand traps, and the like. Centrifuges and like equipment can speed up the separation process by taking advantage of both size and density differences in the mixture being separated.

A typical process used for the separation of drill cuttings and other solids from drilling fluid is shown in FIG. 1, illustrating a stage-wise separation according to the size classifications. Drilling mud 2 returned from the well (not shown) and containing drill cuttings and other additives can be separated in a shale shaker 4, resulting in large particles 5, such as drill cuttings (greater than 500 microns for example), and effluent 6. The drilling fluid and remaining particles in effluent 6 can then be passed through a degasser 8; a desander 10, removing sand 15; a desilter 12, removing silt 16; and a centrifuge 14, removing even smaller particles 17, such as clay. The solids 15, 16, 17 separated, including any weighting materials separated, are then discarded and the clean drilling fluid 18 can be recycled to the mud mixing system (not shown). Agitated tanks (not numbered) can be used between separation stages as holding/supply tanks.

The recovered, clean mud can be recycled, however the mud formulation must often be adjusted due to compounds lost during the drilling process and imperfect separation of drill cutting particles and other drilling fluid additives. As examples of imperfect separations, drilling fluid can be absorbed or retained with drill cuttings during separation; conversely, drill cuttings having a small size can remain with the drilling mud after separations. Losses during the drilling process can occur due to the mud forming a filter cake, and thus depositing drill fluid additives on the wall of the wellbore.

Formation of a filter cake along the wall of the wellbore can occur throughout the drilling process, where drilling additives are used on a continuous basis. Filter cake formation can also be purposeful, such as in areas where drilling fluid circulation is lost. Lost circulation can occur in porous strata, requiring use of loss control additives to seal the openings in the formation, preventing loss of drilling fluids to the permeable formation and regaining drilling fluid circulation. Various agents and additives are known in the art to form formation seals and/or filter cakes on the wall of a well bore. These include sugar cane fibers or bagasse, flax, straw, ground hemp, cellophane strips, ground plastics, ground rubber, mica flakes, expanded perlite, silica slag, ground fir bark, ground redwood bark and fibers, grape extraction residue, cottonseed hulls, cotton balls, ginned cotton fibers, cotton linters, superabsorbent polymers, cellulose fibers, lignite, industrial carbon or graphite, and the like.

The formation of a filter cake along the wellbore may increase the stability of the wellbore. Additionally, use of certain additives, such as industrial carbon, in a loss control pill or throughout the drilling cycle can stabilize shale formations and other sections encountered while drilling. Improved wellbore stability can reduce the occurrence of stuck pipe, hole collapse, hole enlargement, and lost circulation and can improve well control.

While desiring improved wellbore stability, logistics and economics disfavor the use of industrial carbon throughout the entire drilling process. The disposal of the solids separated when cleaning the mud, including the industrial carbon, significantly increases the total amount of industrial carbon needed for the desired filter cake formation. The amount of industrial carbon thus required can increase the costs of drilling, and can require an excessive amount of storage space on a rig.

As an alternative to discarding all of the separated solids, processes for recovery and recycle of polymer beads and glass microspheres, which may be used as an additive in drilling fluids, have been contemplated. For example, U.S. Pat. No. 6,892,887 discloses a process for the separation and recovery of polymer beads from drilling mud, where a mixture of solid particulate materials, drilling fluids, polymer beads, and drilled solids are first passed through a shale shaker and/or a 10 mesh screen recovery apparatus; the large solid materials are discarded; and the remaining materials are passed through a hydrocyclone and a recovery shaker to separate the polymer beads and the fluids.

U.S. Pat. No. 7,004,333 discloses a process for recovering hollow glass microspheres by first screening the drilling mud through one or more 5 to 20 mesh sieves, and then feeding the screened mixture to one or more cyclones and/or hydrocyclones arranged in series, each of which is fed with a volume flow rate from 1.5 to 10 times higher than the maximum nominal operating value to obtain an underflow rich in heavy solids and an overflow rich in a light fraction. The overflow may then be subjected to sedimentation or flotation to recover mud-free microspheres.

Polymer beads and glass microspheres generally have a uniform size, i.e. spherical particles having a narrow particle size distribution, and have a significantly lower density, 0.19 to 1.4 g/cc, than the drilled solids and drill cuttings, approximately 2.6 g/cc. Additionally, polymer beads do not comminute or break down into smaller particles as readily as drill cuttings and other additives used in drilling fluids. These distinguishing properties facilitate the above recovery processes.

It is desired in the industry to recover and recycle other drilling fluid additives, including industrial carbon, calcium carbonate, fibers (natural, synthetic, and cellulosic), polysaccharides, and various minerals. However, in contrast to polymer beads and glass microspheres, the industrial carbon and other materials that are used throughout the drilling process are commonly supplied as particles, of varying particle sizes, uniformity, and shape. Additionally, the drill cuttings and formations encountered during drilling can return particles of similar shape and size to that of industrial carbon, calcium carbonate, and other minerals and additives, and can comminute during circulation through the drill string, each of which can hinder recovery and recycle efforts.

Accordingly, there exists a need for a process useful in separating industrial carbon, calcium carbonate, and other drilling fluid additives from drilling fluids and drill cuttings returned from the wellbore.

SUMMARY OF INVENTION

In one aspect, embodiments disclosed herein relate to a process for the process for the separation and recovery of drilling fluid additives from drilling fluids. In other aspects, embodiments disclosed herein relate to a process for the recovery and recycle of industrial carbon from drilling fluids. In other aspects, embodiments disclosed herein relate to a process for the recovery and recycle of calcium carbonate, fibers, and other minerals from drilling fluids. In other aspects, embodiments disclosed herein relate to processes for the recovery and recycle of one or more of industrial carbon, calcium carbonate, fibers (natural synthetic, and cellulosic), and other minerals and additives from drilling fluids.

In one aspect, embodiments disclosed herein relate to a process for the recovery of drilling fluid additives from a mixture of materials, wherein the mixture may include drilling fluids, drilled solids, and one or more drilling fluid additives from a mud system, the process including the steps of separating at least a portion of the drilled solids from the mixture to form a first effluent and a drilled solids fraction, separating at least a portion of the one or more drilling fluid additives from the first effluent to form a second effluent and one or more recovered additives fractions, and recycling at least a portion of the one or more recovered additives fractions to the mud system. The one or more drilling fluid additives may have a specific gravity of at least 1.4 and an average particle size of at least 2 microns.

In another aspect, embodiments disclosed herein relate to a system for the recovery of drilling fluid additives from a mixture of materials, wherein the mixture may include drilling fluids, drilled solids, and one or more drilling fluid additives from a mud system, the system having means for separating at least a portion of the drilled solids from the mixture to form a first effluent and a drilled solids fraction, means for separating at least a portion of the one or more drilling fluid additives from the first effluent to form a second effluent and a recovered additives fraction, and means for recycling at least a portion of the recovered additives fraction to the mud system. The one or more drilling fluid additives may have a specific gravity of at least 1.4 and an average particle size of at least 2 microns.

In another aspect, embodiments disclosed herein relate to a system for the recovery of drilling fluid additives from a mixture of materials, wherein the mixture may include drilling fluids, drilled solids, and one or more drilling fluid additives from a mud system, wherein the one or more drilling fluid additives may have a specific gravity of at least 1.4 and an average particle size of at least 2 microns. The system may include a first separator for separating at least a portion of the drilled solids from the mixture to form a first effluent and a drilled solids fraction, a second separator in fluid connection with the first separator, wherein the second separator separates at least a portion of the one or more drilling fluid additives from the first effluent to form a second effluent and one or more recovered additives fraction, and a fluid connection from the second separator to the mud system for conveying at least a portion of the recovered additives fraction to the mud system.

Other aspects and advantages of the invention will be apparent from the following description and the appended claims.

DETAILED DESCRIPTION

In one aspect, embodiments disclosed herein relate to a process for the separation and recovery of drilling fluid additives from drilling fluids. In another aspect, embodiments disclosed herein relate to a process for the recovery and recycle of industrial carbon from drilling fluids. In other aspects, embodiments disclosed herein relate to a process for the recovery and recycle of fibers, calcium carbonate, or other minerals from drilling fluids. In other aspects, embodiments disclosed herein relate to processes for the recovery and recycle of one or more of industrial carbon, fibers (natural, synthetic, and cellulosic), calcium carbonate, and other minerals and additives from drilling fluids.

As used herein, industrial carbon may refer to coal, lignite, industrial carbon, natural graphite, graphite flakes, graphite fibers, synthetic graphite, coke, calcined petroleum, calcined pitch, semi-graphitized coke, metallurgical coke, petroleum coke, carbon fibers, solid graphite, pelletized carbons, and the like.

Figure 1:
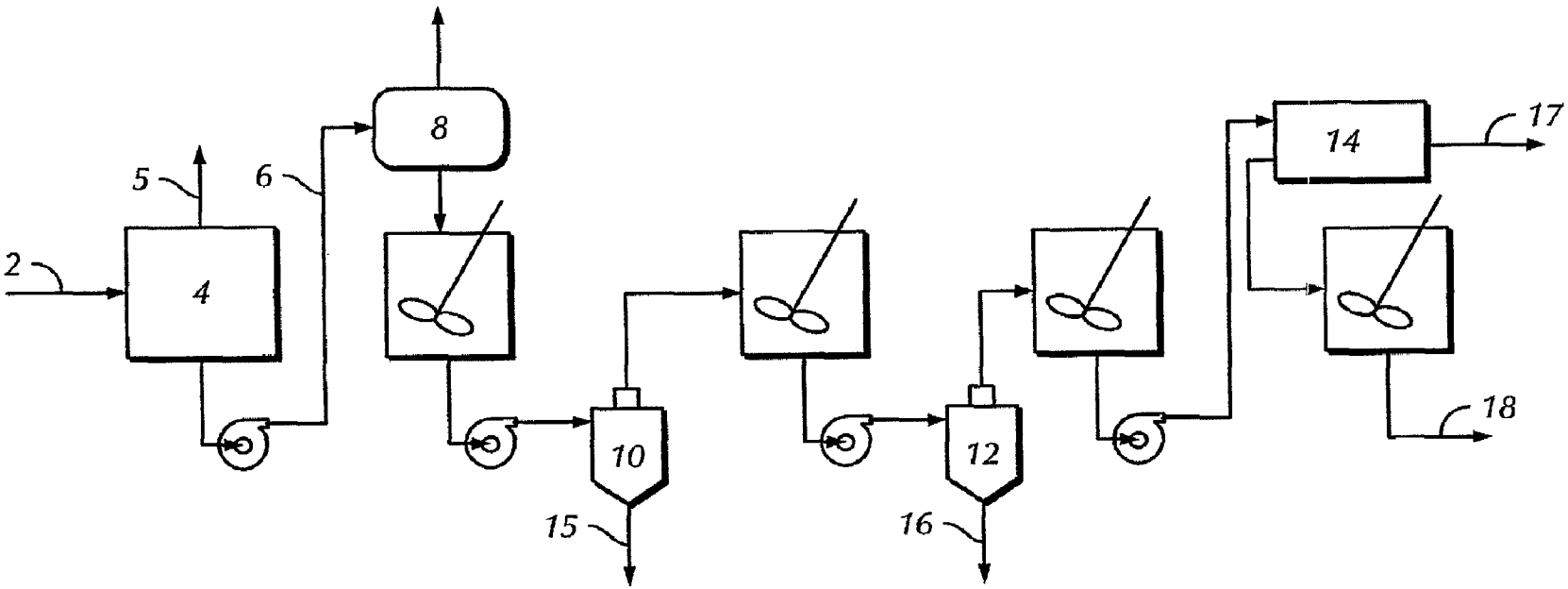
FIG. 1 PRIOR ART
FIG. 1 (prior art) is a simplified flow diagram of a prior art process for cleaning drilling mud.
Figure 2:
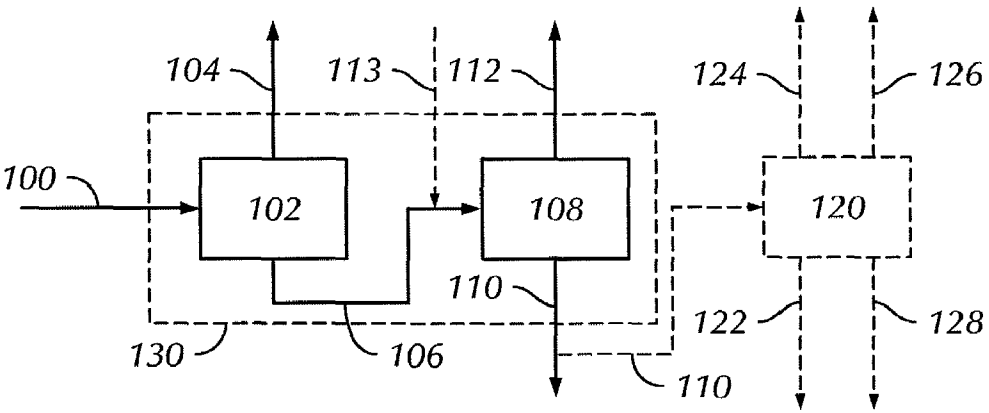
FIG. 2 is a simplified flow diagram of embodiments of the process to recover drilling fluid additives from drilling mud described herein.

Referring to FIG. 2, one embodiment of a process for the separation and recovery of drilling fluid additives, such as industrial carbon material, from drilling mud is shown. FIG. 2 presents a general flow diagram showing a simplified version of the process. One of ordinary skill in the art would recognize that additional equipment including vessels, pumps, augers, valves, and the like may be required for the process, although not shown.

Drilling mud, containing drilling fluid additives (such as industrial carbon, fibers, calcium carbonate, and other minerals) and optionally other additives (such as weighting materials, including barite), as needed, circulates down through the drill pipe or drill string, out the drill bit, picks up drill cuttings, and the mixture circulates back to the surface (not shown). The combined mud 100, a mixture containing drill cuttings, drilling fluid, drilling fluid additives, and other additives, is fed to a first separator 102, which separates the combined mud 100 into particles 104 and first effluent 106.

First separator 102 may include one or more shakers, multi-deck shakers, screen separators, centrifuges, hydrocyclones, filtration systems, or the like, or combinations thereof. First separator 102 may separate large particles from combined mud 100. In some embodiments, first separator 102 separates a fraction of the drill cuttings and other drilling mud components having an average particle size greater than an average particle size of the drilling fluid additives in combined mud 100 such that at least a fraction of the drilling fluid additives may remain with first effluent 106, along with other particles not separated in first separator 102. In other embodiments, a majority of the drilling fluid additives may remain with first effluent 106.

First effluent 106 may be recovered from first separator 102 and transported to a second separator 108, where first effluent 106 may be separated into second effluent 110 and recovered additive fraction 112. Second separator 108 may include one or more screen separators, centrifuges, hydrocyclones, dryers, hydrocyclone shakers, or combinations thereof, for example. In other embodiments, second separator 108 may also include a vertical centrifuge, a shaker, multi-deck shakers, a filtration system, a mud cleaner, or the like. In embodiments, second separator 108 may separate a recovered additive fraction 112 which includes particles having an average particle size similar to that of the drilling fluid additives added to the mud system. In this manner, a majority of the drilling fluid additives may be recovered from combined mud 100.

First effluent 106 may be optionally diluted with an internal olefin stream 113 prior to being fed to second separator 108. Internal olefin stream 113 may be used to lower the viscosity of first effluent 110, potentially enhancing the separations achieved in second separator 108.

Recovered additives fraction 112, which may include drilling fluid additives and other particles of similar size, may be recycled to the mud system as needed, or may undergo further processing. Second effluent 110 may also be recycled to the mud system, as second effluent 110 has been cleaned of large particle size drill cuttings and other particles in separators 102, 108.

Alternatively, second effluent 110 may be further processed to recover smaller particles, such as weighting agents, barite, polymer beads, or other additives. For example second effluent 110 may be fed to one or more additional separators 120, which may include centrifuges, desanders, desilters, mud cleaners, screen separators, shakers, hydrocyclones, or the like, and combinations thereof. The processing of second effluent 110 through separators 120 may result in one or more recovered materials such as clay 122, sand 124, silt 126, and clean drilling fluid 128. Clay 122, clean drilling fluid 128 and any other additives recovered from additional separators 120 may be recycled to the mud system, as needed.

Components recovered in particles 104, sand 124, and silt 126 may be combined for disposal, further processing, or other various uses. These streams (104, 124, and 126) may also be processed independent of one another. Where additional removal of organic materials is required, the recovered particles may be thermally or chemically treated. Useful end products may also be formed from the particles 104, sand 124, and silt 126. For example, where particles 104, sand 124, and/or silt 126 contain drill cuttings from strata comprised of various clays (such as smectite clays, attapulgite clays, kaolin clays, and others), the recovered particles may be further processed to form supports, catalysts, activated clays, or other useful products.

In some embodiments, first separator 102 and second separator 108 may be integrated in a single separation apparatus, as illustrated in FIG. 2 as unit 130. For example, first and second separators 102, 108 may be integrated as a multi-deck shaker, where the drilling mud is fed to a top deck, separating particles 104 from first effluent 106. First effluent 106 is transported internally in unit 130 to a lower deck, which separates the first effluent 106 into second effluent 110 and recovered additives fraction 112. In some embodiments, a recycle loop from the lower deck to the top deck may provide for additionally separation efficiency. Integration of two or more separators in this manner may advantageously allow for the desired separations to be achieved in a limited space. For example, a multi-deck shaker, such as BEM-600 or BEM-650, available from M-I LLC, Houston, Tex., may be used where limitations are imposed on the height of the separator and/or where limitations are imposed on the total area that the separation process may encompass.

Figure 3:
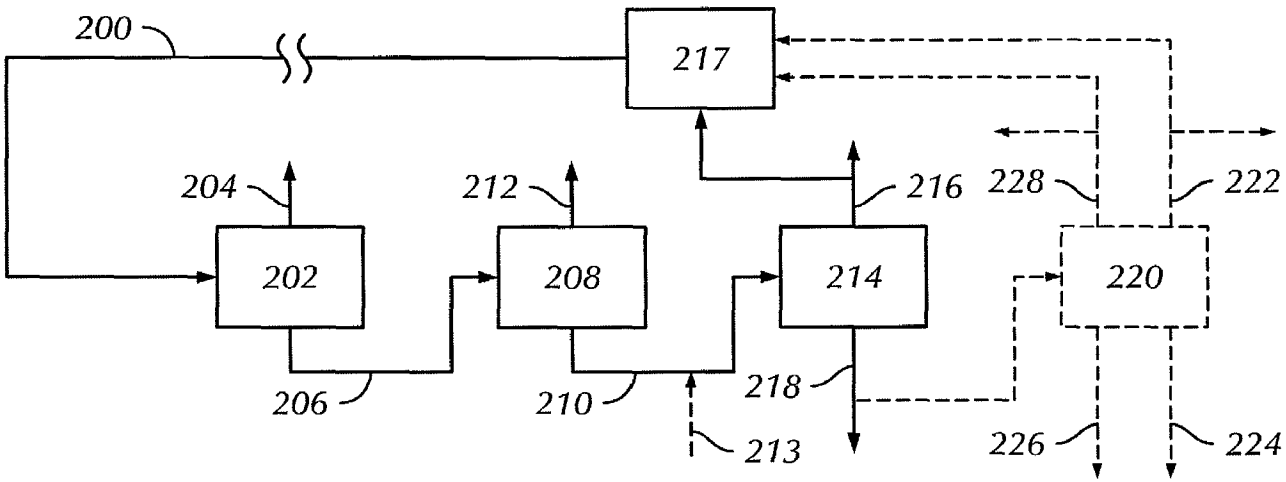
FIG. 3 is a simplified flow diagram of embodiments of the process to recover drilling fluid additives from drilling mud described herein.

Referring now to FIG. 3, another embodiment of a process for the separation and recovery of drilling fluid additives from drilling mud is shown. Drilling mud, containing drilling fluid additives and other additives as needed, circulates down through the drill pipe or drill string, out the drill bit, picks up drill cuttings, and circulates back to the surface (not shown). The mixture 200, containing drilling mud, drilling fluid additives, drill cuttings, and other particles, is fed to a first separator 202, which separates the combined mud 200 into first particle fraction 204 and first effluent 206.

First separator 202 may be a shaker, multi-deck shaker, screen separator, centrifuge, hydrocyclone, filtration system, or the like, or combinations thereof. First separator 202 may separate first particle fraction 204 having particles of 5000 microns and greater from combined mud 200 in some embodiments; 2000 microns or greater in other embodiments; 1000 microns or greater in other embodiments; 500 microns or greater in yet other embodiments. Those having ordinary skill in the art will recognize that these sizes are exemplary only. In embodiments, first separator 202 separates a first particle fraction 204 including drill cuttings and other similarly sized drilling mud components from mixture 200, and a majority of the drilling fluid additives will remain with first effluent 206.

First effluent 206, including any particles not separated and recovered with first particle fraction 204, may be recovered from first separator 202 and transported to second separator 208, where second effluent 210 may be separated from second particle fraction 212. Second separator 208 may be a centrifuge, such as a vertical centrifuge, for example. In other embodiments, second separator 208 may include a centrifuge, a hydrocyclone, a dryer, a shaker, a screen separator, a filtration system, or the like, or combinations thereof.

Second separator 208 may separate second particle fraction 212 having an average particle size of 2000 microns and greater from first effluent 206 in some embodiments; 1000 microns or greater in other embodiments; 500 microns or greater in other embodiments; 400 microns or greater in other embodiments; 250 microns or greater in yet other embodiments. In various embodiments, second separator 208 may separate a second particle fraction 212 including drill cuttings and other similarly sized drilling mud components from combined first effluent 206, where at least a fraction of the drilling fluid additives may remain with second effluent 210; in other embodiments, a majority of the drilling fluid additives may remain with second effluent 210. The fraction of the drilling fluid additives remaining with second effluent 210 may depend upon certain factors, including the size and size distribution of the drilling fluid additives, as well as the type, cut point, and efficiency of the separation device(s) employed, among others.

In some embodiments, second separator 208 may separate second particle fraction 212 and second effluent 210 based upon density. Drill cuttings and drilling fluid additives, such as industrial carbon, fibers (cellulose, natural, or synthetic), polysaccharides, calcium carbonate, or other drilling fluid additives, may have different densities, ranging from slightly different to vastly different depending upon the strata being drilled. Density gradient centrifugation may advantageously be used to separate the drill cuttings from second effluent based upon density, minimizing the amount of drilled solids in second effluent 210. Float-sink separations may also be employed to separate the components based upon density.

Second effluent 210 may be subsequently fed to third separator 214, where recovered additive fraction 216 may be separated from third effluent 218. Second effluent 210 may be optionally diluted with an internal olefin stream 213. Internal olefin stream 213 may be used to lower the viscosity of second effluent 210, potentially enhancing the separations achieved in third separator 214.

Third separator 214 may be a shaker, hydrocyclone, screen separator, mud cleaner, centrifuge, filtration system, or the like, or combinations thereof, and may employ size exclusion separation techniques, density separation techniques, or both. Third separator 214 may separate recovered additive fraction 216 having an average particle size of 1000 microns or greater from second effluent 210; 500 microns or greater in other embodiments; 250 microns or greater in other embodiments; 100 microns or greater in other embodiments; 75 microns or greater in other embodiments; 50, 25, 10, 5, or 2 microns or greater in yet other embodiments. In other embodiments, third separator 214 may separate a recovered additive fraction 216, which may include recovered additives and other particles of similar size, from second effluent 210. Smaller particles, such as clay and other additives, may remain suspended in third effluent 218.

Similarly, the fraction of the drilling fluid additives separated from third effluent 218 may depend upon certain factors, including the size and size distribution of the drilling fluid additives, as well as the type, cut point, and efficiency of the separation device(s) employed, among others. In embodiments, recovered additive fraction 216 may be at least 50 weight percent drilling fluid additives. In other embodiments, recovered additive fraction 216 may be at least 70 weight percent drilling fluid additives; at least 80 percent in other embodiments; 90 weight percent in other embodiments; and 95 weight percent in yet other embodiments.

Recovered additive fraction 216, which may include drilling fluid additives and other particles of similar size, may be recycled to the mud system 217, as needed, or may undergo further processing as described below. Third effluent 218 may also be recycled to the mud system 217, as third effluent 218 has been cleaned of large particle size drill cuttings and other particles in first separator 202, second separator 208, third separator 214, and any further separation processes employed. As described above, two or more of first separator 202, second separator 208, third separator 214, and any further separation processes may be integrated and/or housed in a single separation apparatus, such as a multi-deck shaker.

Optionally, third effluent 218 may be further processed to recover smaller particles, such as barite, polymer beads, or other additives. For example, third effluent 218 may be fed to one or more additional separators 220, which may include centrifuges, desanders, desilters, mud cleaners, screen separators, shakers, hydrocyclones, or the like, or combinations thereof. The processing of third effluent 218 through separators 220 may result in one or more recovered materials such as clay 222, sand 224, silt 226, and clean fluid 228. Clay 222, clean fluid 228 and any other additives recovered from additional separators 220 may be recycled to the mud system 217, as needed for control of mud properties such as weight and viscosity, among others. As above, first particle fraction 204, second particle fraction 212, sand 224, and silt 226 may be disposed of or processed further, individually or in combination.

In the embodiments described above with respect to FIGS. 2 and 3, one or more recovered additives fractions 112, 216 may be recovered using one or more separation devices 108, 214. For example, where it is desired to recover an industrial carbon fraction and a calcium carbonate fraction, separation devices 108, 214 may collect both the industrial carbon and the calcium carbonate in a single particle size range encompassing both additives. Alternatively, separation devices 108, 214 may include one or more separation apparatus, and may collect the industrial carbon and the calcium carbonate in two or more particle size ranges, where the two or more particle size ranges allow for the collection of an industrial carbon rich fraction and a calcium carbonate rich fraction. In this manner, the drilling fluid additives may be recycled in known amounts, allowing for heightened control of the properties of the drilling fluid mixture.

Figure 4:
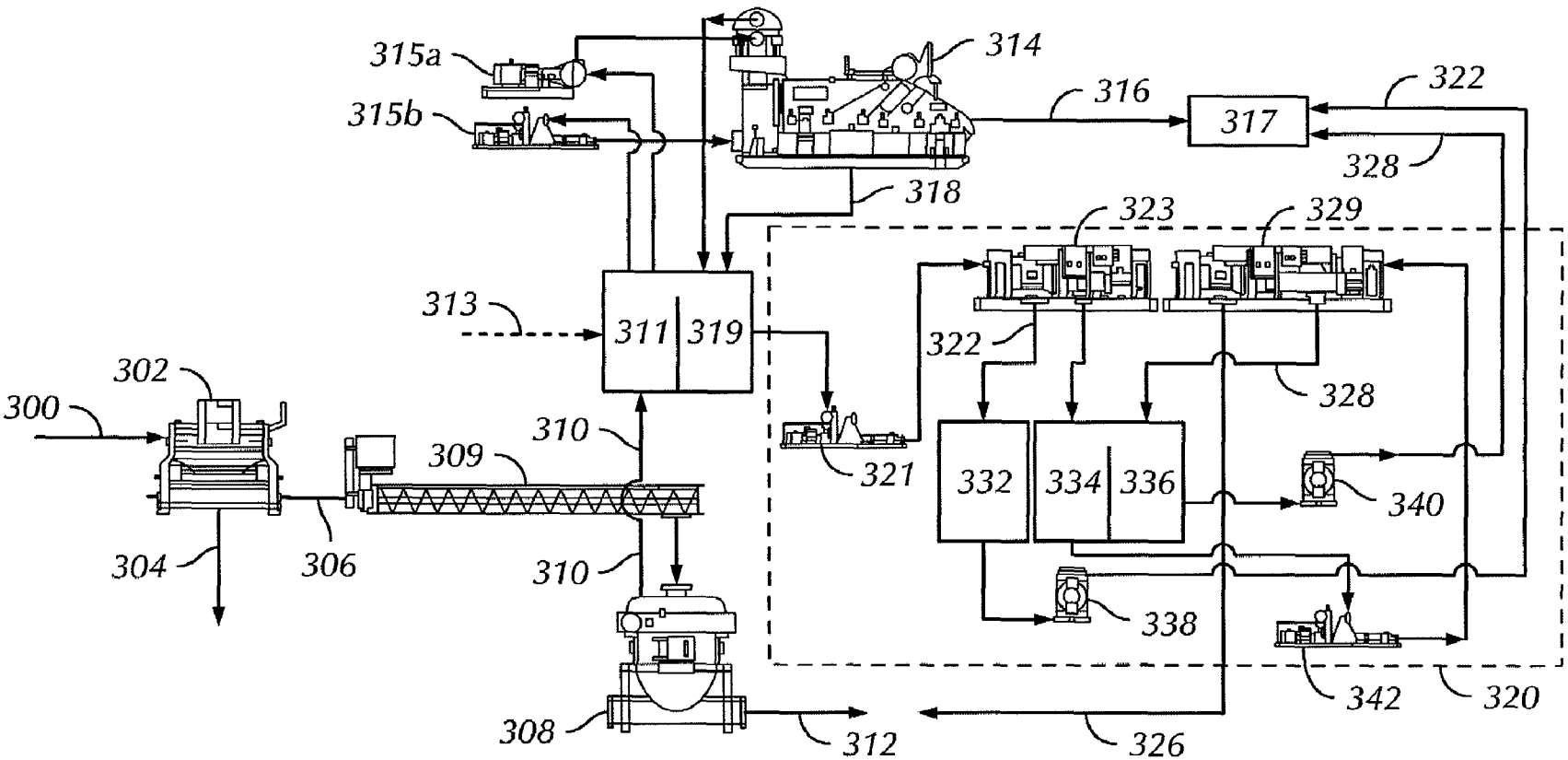
FIG. 4 is a simplified flow diagram of one embodiment of a process to recover drilling fluid additives, such as industrial carbon, from drilling mud described herein.

Referring now to FIG. 4, one embodiment of a process for the separation and recovery of industrial carbon material from drilling mud is shown. Although described with respect to industrial carbon, other drilling fluid additives may also be recovered during or through this process. Drilling mud, containing industrial carbon and other additives as needed, circulates down through the drill pipe or drill string, out the drill bit, picks up drill cuttings, and circulates back to the surface (not shown). The mixture 300, containing drilling mud, industrial carbon, drill cuttings, and other particles, is fed to one or more rig shakers 302 (first separator 302), which separates the combined mud 300 into a first drill cuttings fraction 304 and first effluent 306.

First separator 302 may separate a first drill cuttings fraction 304 having particles of 5000 microns and greater from mixture 300 in some embodiments; 2000 microns or greater in other embodiments; 1000 microns or greater in other embodiments; 500 microns or greater in yet other embodiments. In embodiments, rig shakers 302 separates a first drill cuttings fraction 304 including drill cuttings and other similarly sized drilling mud components from combined mud 300.

First effluent 306, including any particles not separated and recovered with first drill cuttings fraction 304, may be recovered from rig shakers 302 and transported to centrifuge 308 using augur 309. Second effluent 310 may be separated from second drill cutting fraction 312 in centrifuge 308. Centrifuge 308 may be a vertical centrifuge, such as a VERT™-G™ cuttings dryer (available from M-ILLC, Houston, Tex.), for example. Drill cuttings fractions 304, 312 may be disposed of or used as described above. In other embodiments, centrifuge 308 may be a horizontal centrifuge, such as a MUD-10 centrifuge (available from BRANDT, a VARCO corporation, Houston, Tex.).

In some embodiments, centrifuge 308 may separate drill cuttings fraction 312 and second effluent 310 based upon density. Drill cuttings and industrial carbon or graphite may have different densities, ranging from slightly different to vastly different depending upon the strata being drilled. Density gradient centrifugation may advantageously be used to separate the drill cuttings from second effluent based upon density, minimizing the amount of drilled solids in second effluent 310. Float-sink separations may also be employed to separate the components based upon density.

In other embodiments, centrifuge 308 may separate second drill cuttings fraction 312 having an average particle size of 2000 microns and greater from first effluent 306; 1000 microns or greater in other embodiments; 500 microns or greater in other embodiments; 400 microns or greater in other embodiments; 250 microns or greater in yet other embodiments. In some embodiments, centrifuge 308 may separate a second drill cuttings fraction 312 including drill cuttings and other similarly sized drilling mud components from combined first effluent 306, and where at least a fraction of the industrial carbon may remain with second effluent 310.

In certain embodiments, centrifuge 308 may provide a G-force of up to 200 G's up to 400 G's in other embodiments; up to 600 or more G's in yet other embodiments. In certain embodiments, the G-force applied by the centrifuge may vary along the length of the basket or screen. In other embodiments, centrifuge 308 may provide a screen having a mesh size between 10 and 100 mesh; between 15 and 75 mesh in other embodiments; and from 20 to 65 mesh in yet other embodiments.

Second effluent 310 may be subsequently fed to tank 311, and then pumped to hydrocyclone shaker 314 using pumps 315*a*, 315*b*. Industrial carbon fraction 316 may be separated from third effluent 318 in hydrocyclone shaker 314. Second effluent 310 may be optionally diluted with an internal olefin stream 313, either in a transfer line or within tank 311. Internal olefin stream 313 may be used to lower the viscosity of second effluent 310, potentially enhancing the separations achieved in hydrocyclone shaker 314.

In some embodiments, hydrocyclone shaker 314 may separate an industrial carbon fraction 316 having an average particle size of 500 microns or greater; 250 microns or greater in other embodiments; 75 microns or greater in other embodiments; 2 microns or greater in yet other embodiments. In other embodiments, hydrocyclone shaker 314 may separate an industrial carbon fraction 316, which may include industrial carbon and other particles of similar size, from second effluent 310. Smaller particles, such as clay and other additives, may remain suspended in third effluent 318.

In certain embodiments, hydrocyclone shaker 314 may include one or more hydrocyclones having a hydrocyclone diameter of at least 10 cm (4 inches). In other embodiments, hydrocyclone shaker may have a hydrocyclone diameter from 0.4 to 27.5 cm (1 to 18 inches). The hydrocyclone may have a constant or adjustable apex ranging size from 0.6 to 1.55 cm (about ¼ inch to about ⅝ inch). Hydrocyclone shaker 314 may also include one or more shakers having elliptical or linear motion capabilities. Hydro cyclone shaker 314 may include a shaker having screens ranging in size from 50 to 300 mesh; from 70 to 175 mesh in other embodiments; and from 80 to 120 mesh in yet other embodiments. In some embodiments, the shaker may include one or more screens which are at the same or different angles ranging from 1 to 10 degrees from horizontal.

In embodiments, industrial carbon fraction 316 may be at least 50 weight percent industrial carbon. In other embodiments, industrial carbon fraction 316 may be at least 70 weight percent industrial carbon; at least 80 percent in other embodiments; 90 weight percent in other embodiments; and 95 weight percent in yet other embodiments. Industrial carbon fraction 316, which may include industrial carbon and other particles of similar size, may be recycled to the mud system 317, as needed, or may undergo further processing as described below.

Third effluent 318 may be recovered in tank 319, which may be an independent vessel or a portion of a partitioned vessel which may allow overflow into or from tank 311. Third effluent 318 may be further processed to recover smaller particles, such as barite, polymer beads, or other additives using additional separation process 320. For example, third effluent 318 may be fed to one or more additional separators using pump 321. Barite 322 may be recovered in centrifuge 323; sand and silt 326 may be separated from clean drilling fluid 328 in centrifuge 329. Clay 322, clean fluid 328 and any other additives recovered from additional separation process 320 may be recycled to the mud system 317, as needed for control of mud properties such as weight and viscosity, among others. Sand and silt 326 may be combined with first and second particle fractions 304, 312 for disposal, further processing, or other various end uses, as described above.

Holding vessels or compartments 332, 334, 336, as well as pumps 338, 340, 342 may also be used to facilitate separation process 320.

Figure 5:
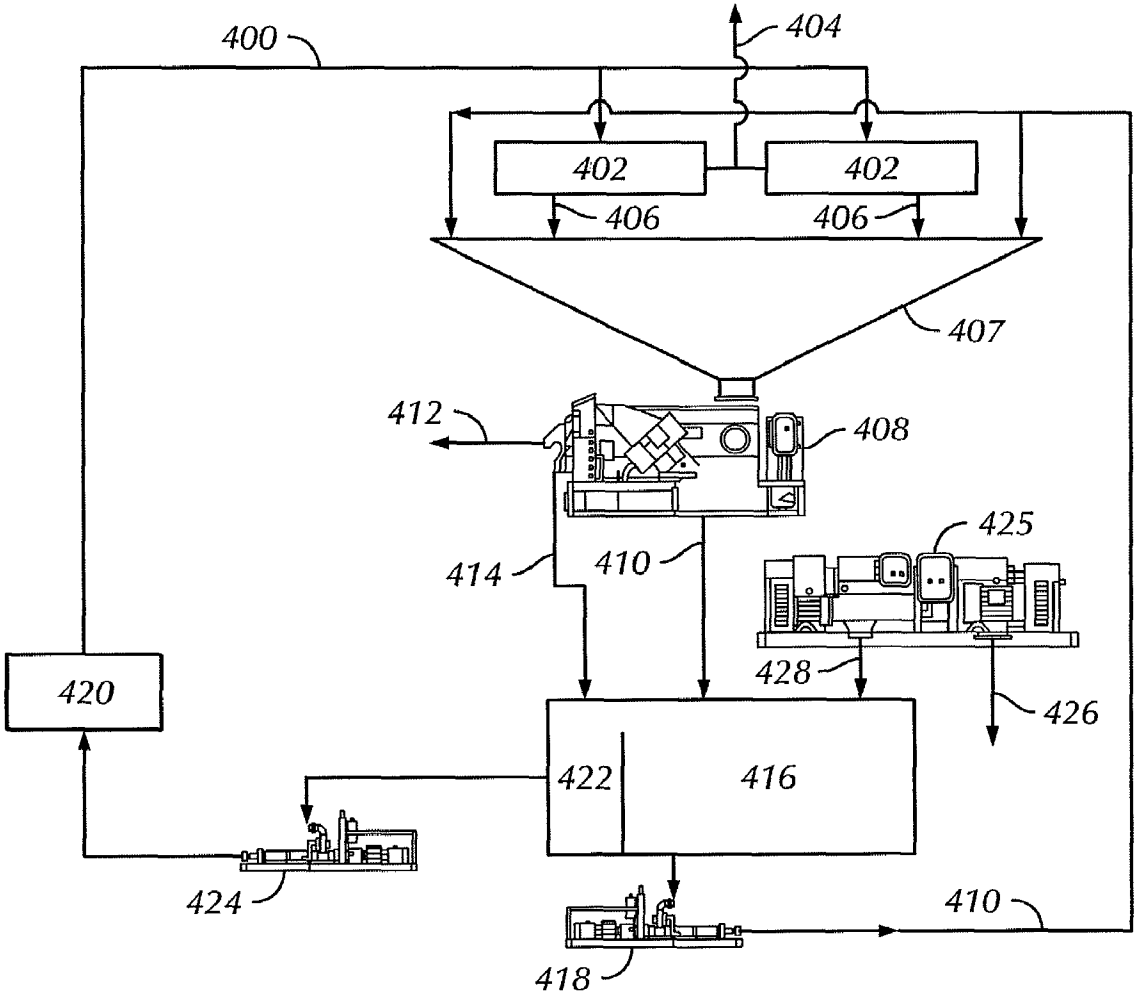
FIG. 5 is a simplified flow diagram of one embodiment of the process to recover drilling fluid additives, such as industrial carbon, from drilling mud described herein.

Referring now to FIG. 5, another embodiment for the separation and recovery of industrial carbon or other drilling fluid additives from drilling mud is shown. Drilling mud containing industrial carbon and/or other drilling fluid additives circulates down through the drill pipe or drill string, out the drill bit, picks up drill cuttings, and circulates back to the surface (not shown). Mixture 400, containing drilling mud, industrial carbon, drill cuttings, and other particles, is fed to one or more rig shakers 402 (first separators 402), which separates the combined mud 400 into a first drill cuttings fraction 404 and first effluent 406.

First separator 402 may separate a first cuttings fraction 404 having particles of 5000 microns and greater from mixture 400 in some embodiments; 2000 microns or greater in other embodiments; 1000 microns or greater in other embodiments; 500 microns or greater in yet other embodiments. In embodiments, rig shakers 402 separate a first drill cuttings fraction 404 including drill cuttings and other similarly sized drilling mud components from combined mud 400.

First effluent 406, including any particles not separated and recovered with first drill cuttings fraction 404, may be recovered from rig shakers 402 and transported to hopper 407, feeding first effluent 406 to multi-deck shaker 408. Second effluent 410 may be separated from second drill cutting fraction 412 and industrial carbon fraction 414 (or a recovered additive fraction 414) in multi-deck shaker 408. Multi-deck shaker 408 may be a dual deck shaker, such as a BEM-600 or BEM-650 shaker (available from M-I LLC, Houston, Tex.), for example. Drill cuttings fractions 404, 412 may be disposed of or used as described above.

As described above with respect to multi-deck shakers, first effluent 406 may be fed to an upper deck, separating particles 412 from an intermediate effluent (not shown), where the intermediate effluent includes drilling fluid additives. The intermediate effluent may then be fed to a lower deck, separating recovered additive or industrial carbon fraction 414 from second effluent 410.

In some embodiments, multi-deck shaker 408 may separate second drill cuttings fraction 412 having an average particle size of 2000 microns and greater from first effluent 406; 1000 microns or greater in other embodiments; 500 microns or greater in other embodiments; 400 microns or greater in other embodiments; 250 microns or greater in other embodiments; 100 microns or greater in yet other embodiments. In some embodiments, multi-deck shaker 408 may separate a second drill cuttings fraction 412 including drill cuttings and other similarly sized drilling mud components from combined first effluent 406, and where at least a fraction of the industrial carbon may remain with the intermediate effluent.

In some embodiments, multi-deck shaker 408 may provide an upper deck screen having a mesh size between 5 and 100 mesh; between 15 and 75 mesh in other embodiments; and from 20 to 65 mesh in yet other embodiments. In other embodiments, multi-deck shaker 408 may provide a lower deck screen having a mesh size between 10 and 1000 mesh; between 20 and 750 mesh in other embodiments; and from 35 to 500 mesh in yet other embodiments.

In some embodiments, multi-deck shaker 408 may separate recovered additive or industrial carbon fraction 414 or a drilling fluid additive fraction 414 having an average particle size of 500 microns or greater; 250 microns or greater in other embodiments; 150 microns or greater in other embodiments; 100 microns or greater in other embodiments; 75 microns or greater in other embodiments; 50 microns or greater in other embodiments; 25 microns or greater in other embodiments; 10 microns or greater in other embodiments; 5 microns or greater in other embodiments; 2 microns or greater in yet other embodiments. In other embodiments, multi-deck shaker 408 may separate recovered additive or industrial carbon fraction 414, which may include recovered additives or industrial carbon and other particles of similar size, from the intermediate effluent. Smaller particles, such as clay and other additives, may remain suspended in second effluent 410.

Second effluent 410 may be subsequently fed to tank 416, and then recycled using pump 418 to active mud system 420 or used as a flush or dilution medium for hopper 407 and multi-deck shaker 408. Recovered additive or industrial carbon fraction 414 may be subsequently fed to tank 422, and then recycled to mud system 420 using return pump 424.

In embodiments, recovered additive fraction 414 (or recovered additive fractions 112, 216, 316 as described in various embodiments) may be at least 50 weight percent drilling fluid additives. For instance, where mixture 400 contains industrial carbon and calcium carbonate, recovered additive fraction 414 may be at least 50 weight percent of a combined weight of industrial carbon and calcium carbonate. In other embodiments, recovered additive fraction 414 may be at least 70 weight percent drilling fluid additives; at least 80 percent in other embodiments; 90 weight percent in other embodiments; and 95 weight percent in yet other embodiments. Industrial carbon fraction 414, which may include industrial carbon and other particles of similar size, may be recycled to the mud system 420 as needed, or may undergo further processing as described below.

In other embodiments, two or more recovered additive fractions 414 may be separated in lower decks of multi-deck shaker 408. In other embodiments, particles 414 may be further separated into two or more recovered additive fractions. In some embodiments, recovered additive fraction 414 may separated into an industrial carbon fraction having at least 50 weight percent industrial carbon; at least 70 weight percent in other embodiments; at least 80 percent in other embodiments; 90 weight percent in other embodiments; and 95 weight percent industrial carbon in yet other embodiments. The recovered industrial carbon fraction, which may include industrial carbon and other particles of similar size, may be recycled to the mud system 420 as needed, or may undergo further processing as described below.

In other embodiments, where particles 414 may be further separated into two or more recovered additive fractions, recovered additive fraction 414 may separated into a calcium carbonate fraction having at least 50 weight percent calcium carbonate; at least 70 weight percent in other embodiments; at least 80 percent in other embodiments; 90 weight percent in other embodiments; and 95 weight percent calcium carbonate in yet other embodiments. The recovered calcium carbonate fraction, which may include calcium carbonate and other particles of similar size, may be recycled to the mud system 420 as needed, or may undergo further processing as described below.

In other embodiments, where particles 414 may be further separated into two or more recovered additive fractions, recovered additive fraction 414 may separated into a fraction having at least 50 weight percent of a mixture of natural fibers, minerals, and polysaccharides, such as used in FORM-A-SQUEEZE® (available from M-I LLC, Houston, Tex.); at least 70 weight percent in other embodiments; at least 80 percent in other embodiments; 90 weight percent in other embodiments; and 95 weight percent of the mixture in yet other embodiments.

In other embodiments, where particles 414 may be further separated into two or more recovered additive fractions, recovered additive fraction 414 may separated into a cellulose fiber fraction, such as used in VINSEAL® (available from M-I LLC, Houston, Tex.) having at least 50 weight percent cellulose fiber; at least 70 weight percent in other embodiments; at least 80 percent in other embodiments; 90 weight percent in other embodiments; and 95 weight percent cellulose fiber in yet other embodiments. The recovered cellulose fiber fraction, which may include cellulose fiber and other particles of similar size, may be recycled to the mud system 420 as needed, or may undergo further processing as described below.

Second effluent 410 may be recovered in tank 416, as described above, which may be an independent vessel or a portion of a partitioned vessel which may allow overflow into or from tank 422. Second effluent 410 may optionally be further processed to recover smaller particles, such as barite, polymer beads, or other additives using additional separation processes 425. For example, second effluent 410 may be fed to one or more additional separators using pump 418. Barite 426 or other weighting agents, such as clays, may be recovered in centrifuge 425; sand and silt may also be separated from clean drilling fluid 428 using one or more additional separation devices. Clay 426, clean fluid 428 and any other additives recovered from additional separation process may be recycled to the mud system 420, as needed for control of mud properties such as weight and viscosity, among others. Sand and silt may also be combined with first and second particle fractions 404, 412 for disposal, further processing, or other various end uses, as described above.

The recovered additive fractions recovered by any of the above processes may be recycled to a mud system. Alternatively, the recovered additive fractions may undergo further separations prior to recycle, forming at least one fraction of enhanced drilling fluid additive content, as described above. As used herein, a fraction having enhanced content is defined as having a higher weight percent of a desired additive than the recovered additive fraction prior to undergoing further separations. One or more of such streams having enhanced additive content may be recycled to the mud system as needed.

For example, as one alternative, the industrial carbon fraction, the calcium carbonate fraction, or any other recovered additive fraction may undergo one or more screen separations, isolating particles of discrete size ranges. The discrete size ranges having an undesirable amount of drill cuttings may be discarded, and the discrete size ranges having acceptable drilling fluid additives concentrations may be recycled to the mud system. As another alternative, the industrial carbon fraction, for example, may undergo one or more density separations, isolating particles of discrete density ranges, further separating the industrial carbon from the drill cuttings prior to recycle. For example, drill cuttings may have a density average of approximately 2.6 g/cc, typically ranging from 2 g/cc to 8 g/cc or more, whereas industrial carbon may have a density of approximately 2.1 g/cc, typically ranging anywhere from 1 g/cc to 2.5 g/cc. This difference in density may allow float-sink, centrifugal, or other density or density gradient separation methods to separate the industrial carbon from the heavier drill cuttings. In either of these manners the amount of drill cuttings recycled to, and potentially building up in, the mud system may be minimized.

Due to the variations in formations encountered during drilling operations, the efficiency of the drilling fluid additives recovery process may vary. To account for variations in the drilling mud compositions and the sizes of particles returning to the surface, the screen mesh sizes or other variables affecting particle separations may be adjusted as needed to maintain a desired degree of industrial carbon separation and recovery.

Drilling mud fed to the wellbore, or that coming from the wellbore may have up to 5 pounds per barrel (ppb) industrial carbon in some embodiments; up to 10 ppb in other embodiments; up to 15 ppb or greater in yet other embodiments. In embodiments of the process for the separation of drilling fluid additives from drilling fluids, 50 weight percent or more of the industrial carbon returning with the drilling mud from the wellbore may be recovered in the recovered additives fractions; 65 weight percent or more in other embodiments; 75 percent or more in other embodiments; 85 percent or more in other embodiments 90 percent or more in yet other embodiments.

Drilling mud fed to the wellbore, or that coming from the wellbore may have up to 5 pounds per barrel (ppb) calcium carbonate in some embodiments; up to 10 ppb in other embodiments; up to 15 ppb or greater in yet other embodiments. In embodiments of the process for the separation of drilling fluid additives from drilling fluids, 50 weight percent or more of the calcium carbonate returning with the drilling mud from the wellbore may be recovered in the recovered additive fractions; 65 weight percent or more in other embodiments; 75 percent or more in other embodiments; 85 percent or more in other embodiments 90 percent or more in yet other embodiments.

EXAMPLES

Samples from two different drilling operations were collected and analyzed to determine where in the process the industrial carbon was being discarded. Although these samples reflect only one or two types of strata encountered during drilling, the analyses of the samples indicate that a size or density separation may be used to sufficiently isolate the industrial carbon for recycle to an active mud system.

Sample 1: Industrial carbon (G-SEAL®, available from M-I LLC, Houston, Tex.; average particle size of 450 microns, particle diameters ranging from 200-600 microns) was used as an additive in drilling mud during drilling operations. During mud cleaning operations, drilling mud containing drill cuttings and industrial carbon was separated, using shakers having sequentially larger mesh sizes as shown in Table 1. The drilling mud Sample 1 was initially separated in 10 and 40 mesh shakers. The effluent from the 40 mesh shaker was then separated in parallel across screens ranging in size from 84 to 175 mesh. The total flow was 935 gpm separated between the four shakers. Samples of the particles recovered in each screen were collected. The solids recovered during each separation stage were then visually analyzed to determine the approximate concentration of industrial carbon within the recovered samples.

Figure 6:
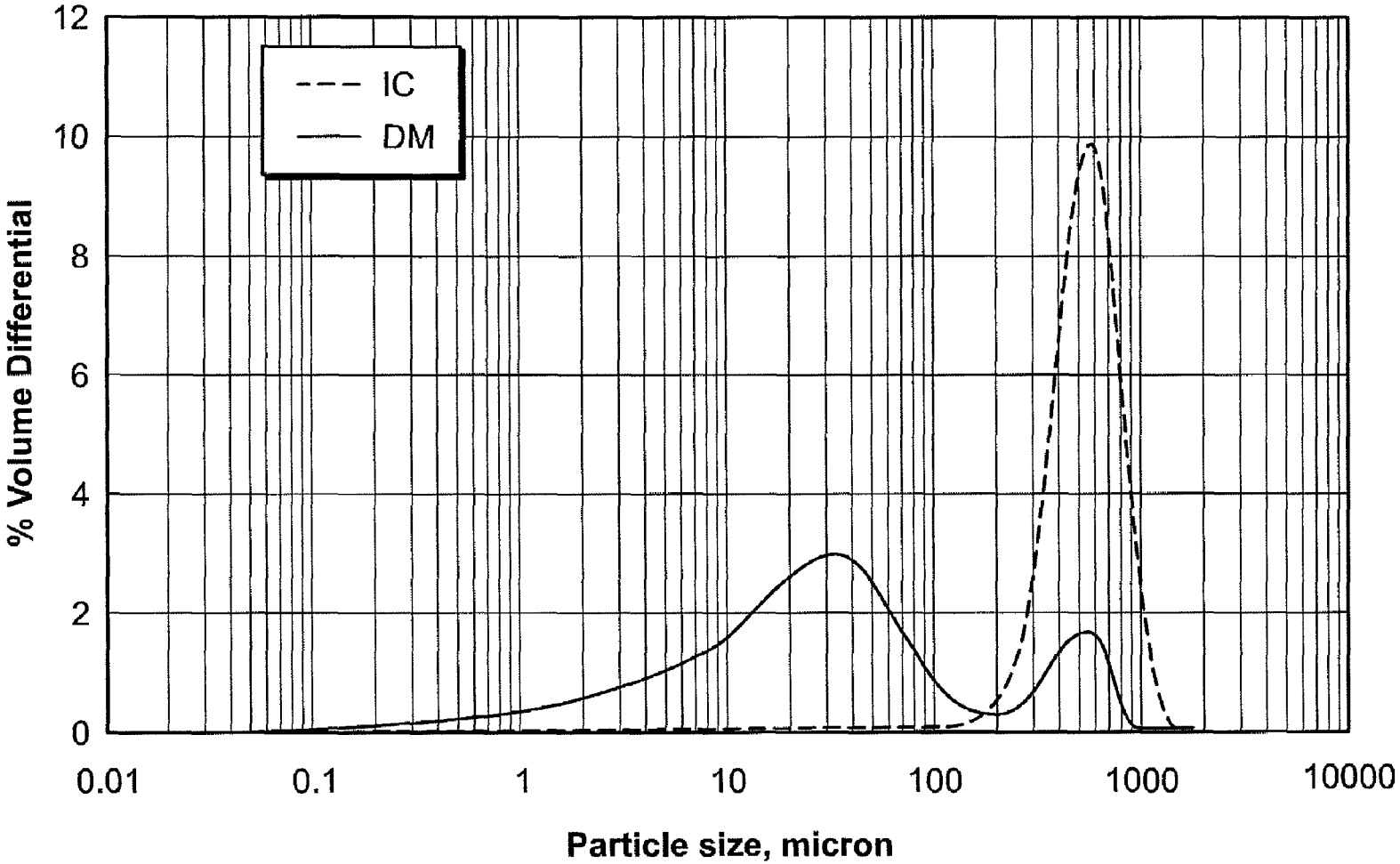
FIG. 6 is a graphical illustration of the particle size distribution of industrial carbon sample and solids recovered from a sample collected from a mud cleaning system.

Sample 2: Industrial carbon (G-SEAL®, available from M-I LLC, Houston, Tex.) was used as an additive in drilling mud during drilling operations. Drilling mud containing drill cuttings and industrial carbon was collected from a flowline sample point after a MUD™-10 centrifuge and prior to further mud cleaning operations. The initial particle size distribution of the G-SEAL® ("IC") added to the mud system and the particle size distribution of the drilling mud sample ("DM") are shown in FIG. 6. The industrial carbon had an average particle size diameter of approximately 650 microns, with particles ranging in size from 150 to 1500 microns. Sample 2 was initially separated in a 40 mesh shaker. The effluent from the 40 mesh shaker was then separated using shakers (84 mesh and 110 mesh) and mudcleaners in parallel, similar to the Sample 1 analyses. The solids recovered during each separation stage were then visually analyzed to determine the approximate concentration of industrial carbon within the recovered samples, with the results as shown in Table 1.

TABLE 1

Percent industrial carbon in recovered samples at various mesh sizes.

| | Sample 1 % Industrial Carbon in sample | Sample 2 % Industrial Carbon In sample |
|---|---|---|
| 10 Mesh Shaker (2000 micron) | 5 | |
| 40 Mesh Shaker (420 micron) | 50 | 40 |
| 84 Mesh Shaker (186 micron) | 75 | 64 |
| 110 Mesh Shaker (139 micron) | 95 | 96 |
| 140 Mesh Shaker (107 micron) | 95 | |
| 175 Mesh Shaker (85 micron) | 95 | |
| Mudcleaner Cones | | 50 |
| Mudcleaner Cones/210 Mesh (70 micron) | | 70 |

Figure 7A:
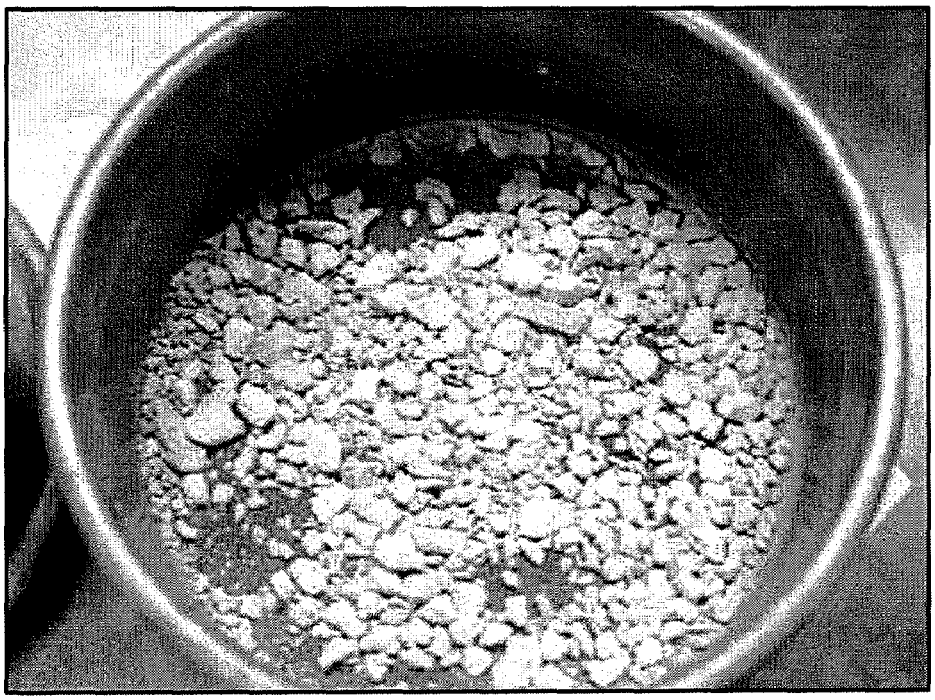
FIG. 7*a* is a picture of drill cuttings and other particles recovered from a drilling mud sample.

FIG. 7*a* is a picture of drill cuttings and other particles recovered from a drilling mud sample. The particles were recovered using a 10-mesh screen (2000 microns). Industrial carbon is dark in color (graphite). The color of the large particles recovered from the 10-mesh screen indicates very little industrial carbon.

Figure 7B:
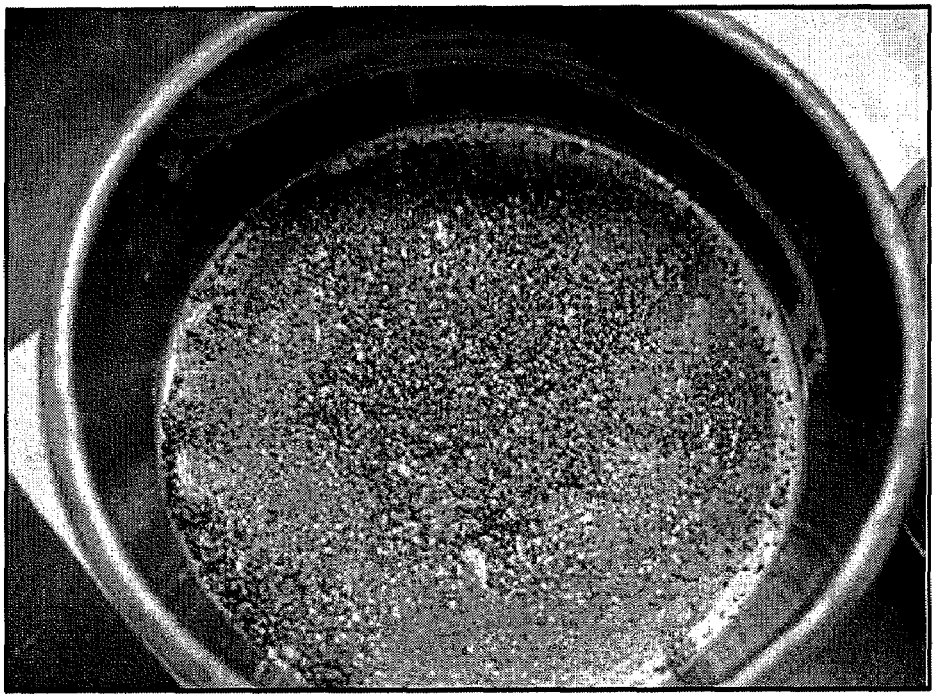
FIG. 7*b* is a picture of industrial graphite and other particles recovered from a drilling mud sample (darker material is industrial graphite)

FIG. 7*b*, on the other hand, is a picture of solids recovered from the effluent of the 10-mesh screen used to recover the large solids illustrated in FIG. 7*a*. The industrial graphite, darker in color, appears to be a majority of the solids collected from the effluent sample, in the range of 90% industrial carbon based on visual observation.

Figure 8:
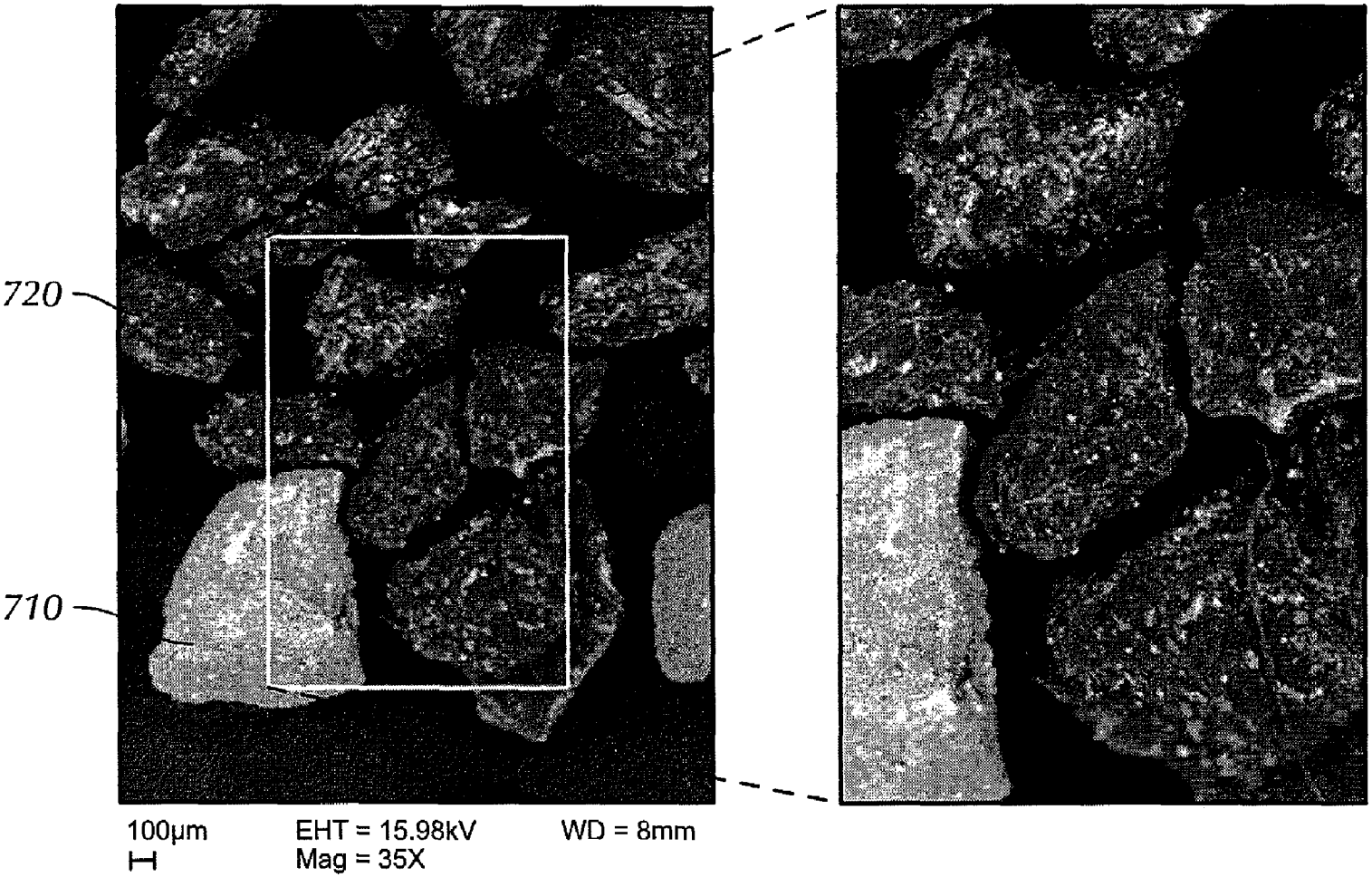
FIG. 8 is a dual magnification image illustrating details of drill cuttings (light gray particle) and industrial graphite (darker elements).

As mentioned above, the industrial carbon materials are commonly supplied as particles, of varying particle sizes, uniformity, and shape, and the drill cuttings and formations encountered during drilling often return particles of a similar shape and size, thus increasing the difficulty of industrial carbon recovery. FIG. 8 is a dual magnification image illustrating details of drill cuttings (light gray particle, 710) and industrial graphite (darker elements, 720), as recovered during the separations performed on Sample 2. FIG. 8 shows the similarity in size of industrial carbon to drill cuttings, illustrating the inherent difficulty in obtaining a complete separation or recovery of the industrial carbon.

For both Sample 1 and Sample 2, approximately 90-95 percent of the particles collected with screens having greater than 100 mesh were industrial carbon. The 84-mesh screen resulted in a sample having between 60 and 80 percent industrial carbon. In this example, an 84-mesh screen could adequately recover the industrial carbon with an acceptable amount of drill cuttings carryover. The 110-mesh screen may have had a significantly higher percentage of industrial carbon due to the series-type separations.

Figure 9:
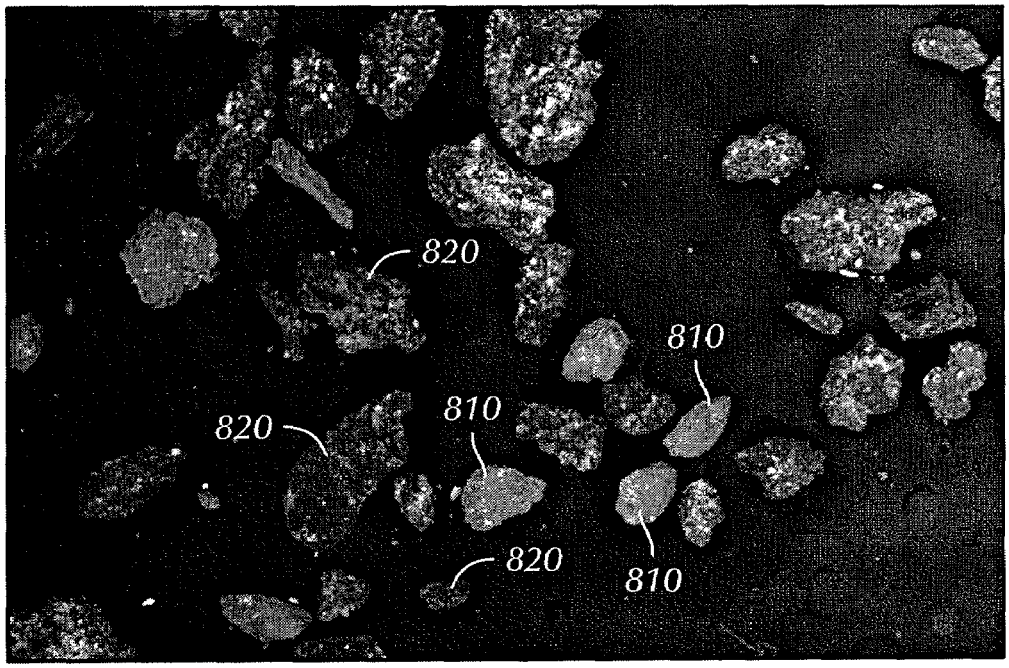
FIG. 9 is an image of particles recovered from an 84-mesh screen.

FIG. 9 is an image of particles recovered from an 84-mesh screen during the separations performed on Sample 2. The particles recovered again included drill cuttings (light gray particles, 810) and industrial carbon (darker particles, 820). Visual analyses indicated that particles recovered using an 84-mesh screen had a relative abundance of industrial carbon of approximately 64 weight percent. Analysis of the particle size indicated that the sizes of particles ranged from 150 to 400 microns, with an average particle size recovered of approximately 200 microns.

Figure 10:
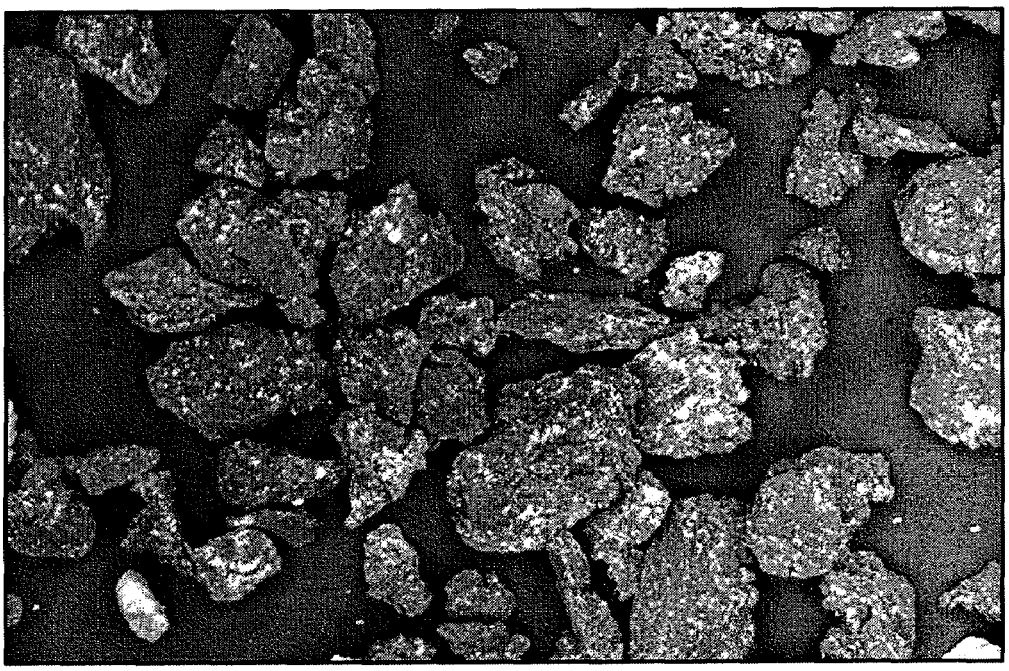
FIG. 10 is an image of particles recovered from a 110-mesh screen.

FIG. 10 is an image of particles recovered from a 110-mesh screen during the separations performed on Sample 2. Visual analyses indicated that particles recovered using a 110-mesh screen had a relative abundance of industrial carbon of approximately 96 weight percent. Analysis of the particle size indicated that the sizes of particles ranged from 150 to 500 microns, with an average particle size recovered of approximately 300 microns.

The specific cut point(s) used during separations may influence both the ability to recover and recycle the industrial carbon with minimal build-up of drill cuttings, and the economic incentive to recycle. Where only one separation step is performed isolating the industrial carbon fraction, it may be preferred to use a screen having between an 84-mesh and a 150-mesh, or a larger mesh number, depending upon the industrial carbon particle size, drill cutting particle size, and the amount of drill particles recovered that may be recycled without significant build-up in the mud system. In a series-type separation scheme, it may be preferred to use screens of increasingly larger mesh numbers, where one or more fractions of industrial carbon recovered may be recycled, again depending upon the particle sizes and build-up concerns. In other embodiments, a screen number of less than 84 may be acceptable.

Advantageously, the present invention provides for a method to recover drilling fluid additives from drilling fluid. The recovered additives may be recycled to the drilling mud system, thereby improving the economics of the drilling process. Additionally, the recovery and reuse of drilling fluid additives may allow for increased usage of drilling fluid additives throughout the drilling cycle, potentially decreasing the amount of lost circulation events, and potentially contributing to enhanced wellbore stability.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

All priority documents are herein fully incorporated by reference for all jurisdictions in which such incorporation is permitted. Further, all documents cited herein, including testing procedures, are herein fully incorporated by reference for all jurisdictions in which such incorporation is permitted to the extent such disclosure is consistent with the description of the present invention.

What is claimed:

1. A process for the recovery of drilling fluid additives from a mixture of materials, wherein the mixture comprises drilling fluids, drilled solids, and one or more drilling fluid additives from a mud system, the process comprising:

separating at least a portion of the drilled solids from the mixture to form a first effluent and a drilled solids fraction;

decreasing a viscosity of the first effluent;

separating at least a portion of the one or more drilling fluid additives from the first effluent to form a second effluent and one or more recovered additives fractions;

recycling at least a portion of the one or more recovered additives fractions to the mud system;

wherein the one or more drilling fluid additives have a specific gravity of at least 1.4; and wherein the one or more drilling fluid additives have an average particle size of at least 2 microns.

2. The process of claim 1, wherein the one or more drilling fluid additives are selected from the group consisting of industrial carbon, calcium carbonate, cellulose fibers, natural fibers, minerals, polysaccharides, and combinations thereof.

3. The process of claim 1, wherein the decreasing the viscosity of the first effluent comprises diluting the first effluent with an internal olefin, a portion of the second effluent, or combinations thereof.

4. The process of claim 1, comprising recycling at least a portion of the second effluent to the mud system.

5. The process of claim 1, wherein the separating at least a portion of the drilled solids is performed in an apparatus selected from the group consisting of screen separators, hydrocyclones, desilters, desanders, mud cleaners, mud conditioners, dryers, drying shakers, centrifuges, hydrocyclone shakers, multi-deck shakers, and combinations thereof.

6. The process of claim 1, wherein the separating at least a portion of the one or more drilling fluid additives is performed in an apparatus selected from the group consisting of screen separators, hydrocyclones, desilters, desanders, mud cleaners, mud conditioners, dryers, drying shakers, centrifuges, hydrocyclone shakers, multi-deck shakers, and combinations thereof.

7. The process of claim 1, wherein the one or more recovered additives fractions comprise at least 60 weight percent drilling fluid additives.

8. The process of claim 1, wherein the recovered additives fraction comprises at least 80 weight percent drilling fluid additives.

9. The process of claim 1, wherein the recovered additives fraction comprises at least 90 weight percent drilling fluid additives.

10. The process of claim 1, wherein the drilled solids fraction comprises particles having an average particle size of 1000 microns or greater.

11. The process of claim 1, wherein the one or more drilling fluid additives comprise particles having an average particle size in the range of 5 to 1000 microns.

12. The process of claim 1, wherein 50 weight percent or more of the one or more drilling fluid additives in the mixture are recovered in the one or more recovered additives fractions.

13. The process of claim 1, wherein the one or more recovered additives fraction comprises an industrial carbon fraction comprising at least 50 weight percent industrial carbon.

14. The process of claim 1, wherein the one or more recovered additives fraction comprises a calcium carbonate fraction comprising at least 50 weight percent calcium carbonate.

15. The process of claim 1, wherein the one or more recovered additives fraction comprises a fraction comprising at least 50 weight percent of a mixture of minerals, fibers, and polysaccharides.

16. The process of claim 1, wherein the one or more recovered additives fraction comprises a cellulose fiber fraction comprising at least 50 weight percent cellulose fiber.

17. The process of claim 1, further comprises decreasing the viscosity of the second effluent.

18. the process of claim 17, wherein the decreasing the viscosity of the second effluent comprises diluting the first effluent with an internal olefin.

* * * * *